US006196984B1

(12) United States Patent
Hashimoto

(10) Patent No.: US 6,196,984 B1
(45) Date of Patent: Mar. 6, 2001

(54) PORTABLE MESSAGE DEVICE

(75) Inventor: Kouji Hashimoto, Osaka (JP)

(73) Assignee: Kabushiki Kaisha Protec Fuji, Osaka-Fu (JP)

( * ) Notice: Subject to any disclaimer, the term of this patent is extended or adjusted under 35 U.S.C. 154(b) by 0 days.

(21) Appl. No.: 09/079,577

(22) Filed: May 15, 1998

(30) Foreign Application Priority Data

Feb. 14, 1998 (JP) ..... 10-048917

(51) Int. Cl.[7] ..... A61H 15/00

(52) U.S. Cl. ..... 601/122; 601/115; 601/126; 601/127; 601/133; 601/134

(58) Field of Search ..... 601/127, 122, 601/124, 126, 27, 32, 115, 133, 134

(56) References Cited

U.S. PATENT DOCUMENTS

| | | | | |
|---|---|---|---|---|
| D. 305,563 | | 1/1990 | Yamasaki . | |
| D. 349,772 | | 8/1994 | Yamasaki et al. . | |
| 1,630,911 | * | 5/1927 | Wentz | 601/127 |
| 2,052,656 | | 9/1936 | Prien . | |
| 2,306,424 | | 12/1942 | Betz . | |
| 2,446,099 | * | 7/1948 | Niblack | 601/127 |
| 2,633,123 | | 3/1953 | Bell . | |
| 3,398,741 | | 8/1968 | Burk . | |
| 4,016,872 | | 4/1977 | Yamamura et al. . | |
| 4,127,116 | | 11/1978 | Pannetier . | |
| 4,505,267 | | 3/1985 | Inada . | |
| 4,506,660 | * | 3/1985 | Curran | 128/57 |
| 4,716,891 | * | 1/1988 | Yorgan | 128/57 |
| 4,782,823 | * | 11/1988 | Yamasaki | 128/57 |

FOREIGN PATENT DOCUMENTS

| | | | | |
|---|---|---|---|---|
| 480824 | * | 4/1992 | (EP) | 601/127 |
| 3268757 | * | 11/1991 | (JP) | 601/127 |
| 4-102454 | | 4/1992 | (JP) . | |

OTHER PUBLICATIONS

Five sheets of drawings from Applicant's copending application Serial No. 09/044 472, filed Mar. 19, 1998.

* cited by examiner

*Primary Examiner*—Richard J. Apley
*Assistant Examiner*—Tam Nguyen
(74) *Attorney, Agent, or Firm*—Flynn, Thiel, Boutell & Tanis, P.C.

(57) ABSTRACT

A portable massage device having kneading, finger rolling and tapping rolling features, so as to provide three kinds of massage effects. In order to provide these massage effects, a driving mechanism is disposed on a fixed plate and includes a driven rotary shaft. The speed of the driving mechanism can be changed, and two drum shaped tube members are provided which include a plurality of kneading members. The drum shaped tube members are oriented adjacent opposite ends of the driven shaft, and a pair of round plates are provided at the inner ends of the respective drum shaped members so that kneading massage can be provided. Finger rolling and tapping rolling massage can be provided by the kneading members.

16 Claims, 5 Drawing Sheets

PORTABLE MESSAGE DEVICE

BACKGROUND OF THE INVENTION

1. Field of the Invention

The present invention relates to a portable massage device, more specifically to a portable massage device which can select kneading massage, tapping rolling massage or finger pressure rolling massage, and can do said massages in the same time.

2. Description of the Prior Art

Since olden times, many kinds of massage devices have been provided to massage the human body, specifically, a portable massage device has been widely employed for easy portable use, low cost and good massage effect.

For example, a portable massage apparatus which has a rotatable rolling massage member to touch and rub a human body to provide a rolling massage, and which has a pair of opposed eccentric members disposed on the center part of a drive shaft to provide a kneading massage to the human body, can provide good massage effects to stimulate blood circulation properly for relieving fatigue of a patient.

However, the above-identified portable massage apparatus can provide rolling massage, or kneading massage, but it cannot provide a tapping massage.

The problem of insufficient space exists for disposing a complex mechanism on a portable massage device which already has a rolling massage mechanism and a kneading massage mechanism. Further, increased costs are a problem since it is too difficult to dispose a tapping mechanism or a finger pressure mechanism on existing devices.

Therefore, it is an object of the present invention to provide a portable massage device designed so as to have a finger pressure rolling feature, kneading feature and a tapping rolling feature that can provide three kinds of massage effects.

And it is a further object of the present invention to provide a portable massage device designed so as to have these features but a low manufacturing cost, and these massage features can be wilfully selected for use.

And it is a further object of the present invention to provide a portable massage device which can provide the capability of selectively using the kneading feature or finger pressure feature or tapping feature on a human body.

SUMMARY OF THE INVENTION

The portable massage device of the present invention includes a driving mechanism disposed on a pair of fixed plates of an outside frame, a driven rotary shaft which is held on said fixed plates of the outside frame, and can be rotatably driven by said driving mechanism, drum shaped tube members disposed on said driven rotary shaft, and in which a plurality of kneading members are erected in eccentric status with respect to the axis.

Further, a portable massage device of the present invention includes a reducer disposed on said driving mechanism, which can change the speed of said driving mechanism.

Further, a portable massage device of the present invention has said drum shaped tube members disposed on two sides of the driven rotary shaft, and in which a plurality of kneading members are erected in eccentric status with respect to the axis.

Furthermore, a portable massage device of the present invention includes a pair of round plate members inlaid in opposite sides of the two drum shaped tube members in the center part of said driven rotary shaft.

Further, a portable massage device of the present invention includes said round plate members inlaid in opposite sides of the two drum shaped tube members in different eccentric positions, in which a plurality of kneading members are erected in eccentric status with respect to the axis.

Further, the tube members include two side edges which are formed as egg shaped or elliptic shaped, and a plurality of kneading members are disposed on outside circles between them.

DETAILED DESCRIPTION

Figure 1:
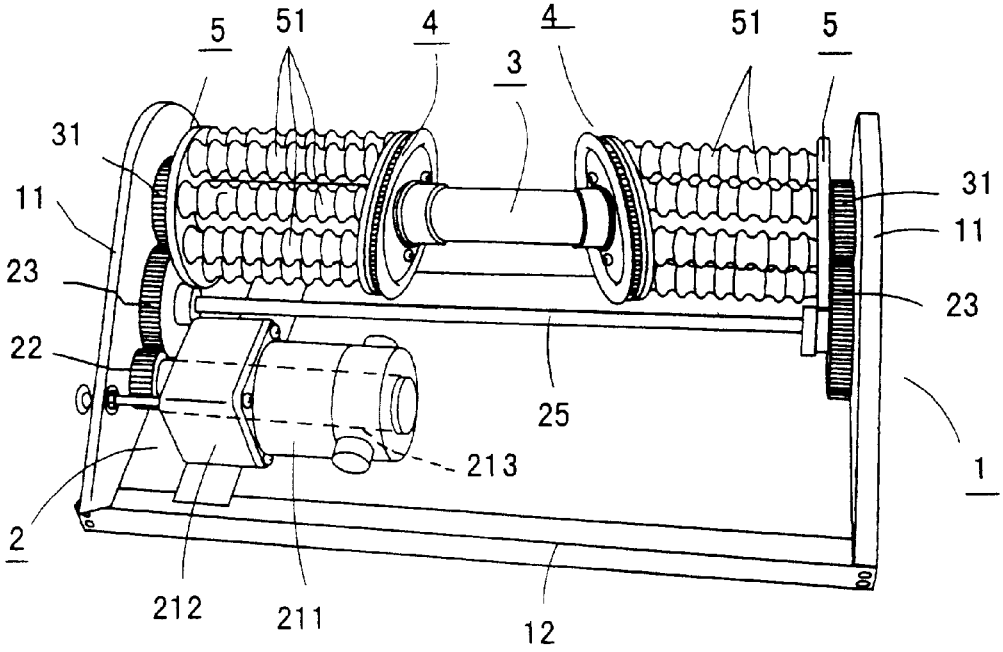
FIG. 1 is an oblique drawing showing an inner mechanism of the portable massage device which is an embodiment of this invention.
Figure 2:
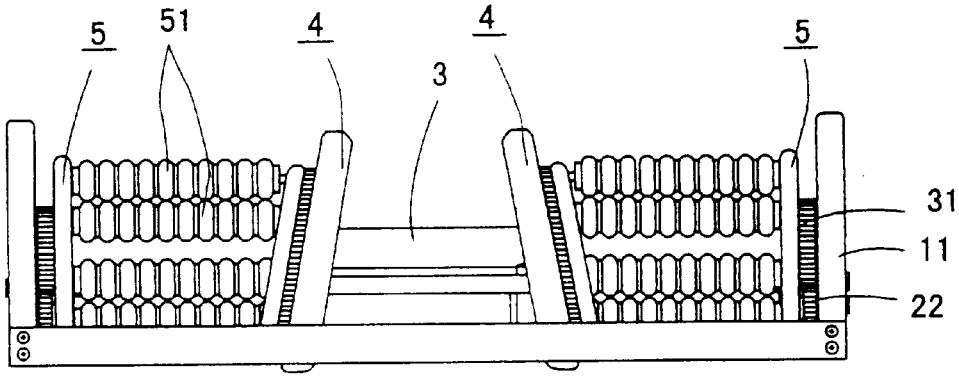
FIG. 2 is a front view showing an inner mechanism of the portable massage device which is an embodiment of this invention.
Figure 3:
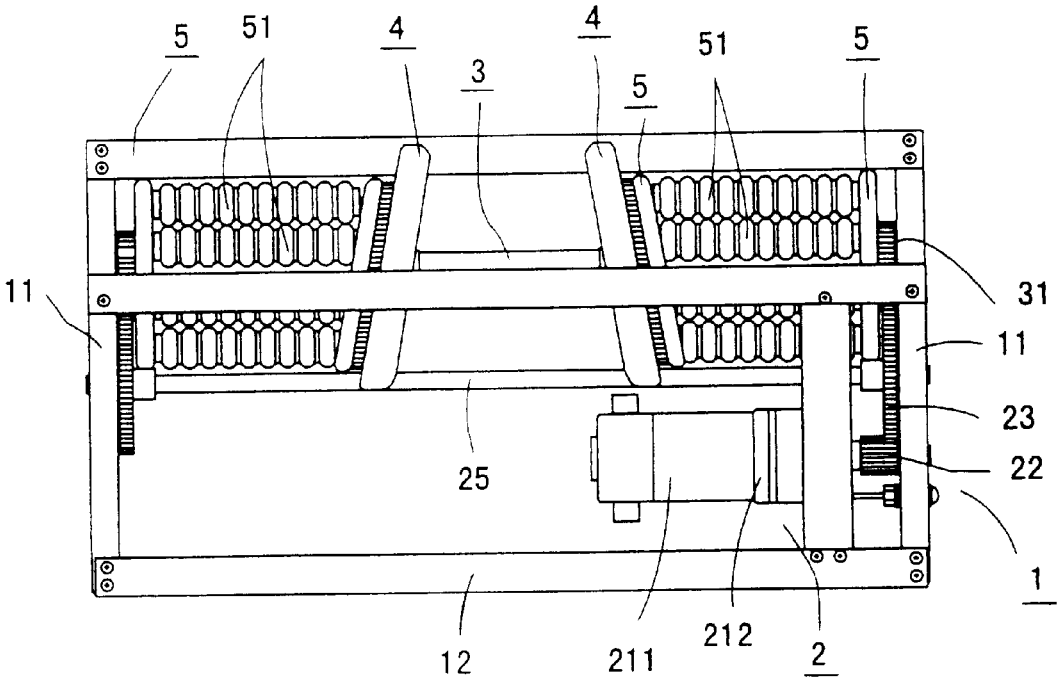
FIG. 3 is a bottom view showing an inner mechanism of the portable massage device which is an embodiment of this invention.

As shown in FIG. 1, the portable massage device of the present invention includes a driving mechanism 2 disposed on a pair of fixed plates 11·11 of an outside frame 1, a driven rotary shaft 3 which is held on said fixed plates 11 of the outside frame 1, and can be driven to rotate by said driving mechanism 2 simultaneously, and a drum shaped tube member 5 disposed on said driven rotary shaft 3 (i.e. the hollow center of member 5 receives the shaft 3 therethrough and is fixed to the shaft 3 by conventional means, e.g. set screw, welding, etc.), and in which a plurality of kneading members 51 are erected in eccentric status with the rotational axis defined by the shaft 3.

Figure 11:
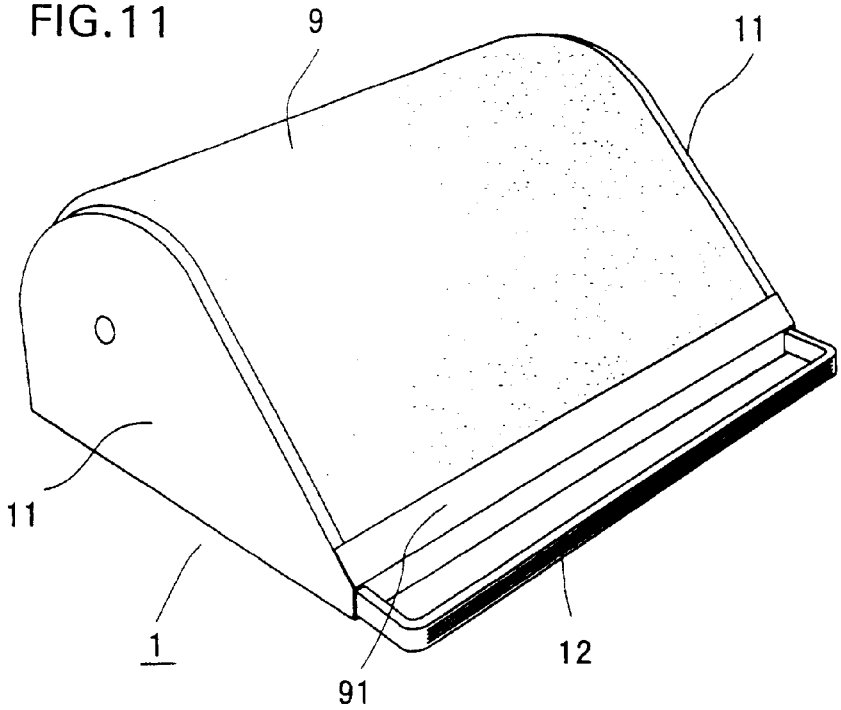
FIG. 11 is an oblique drawing showing the portable massage device which represents one embodiment of this invention.
Figure 12:
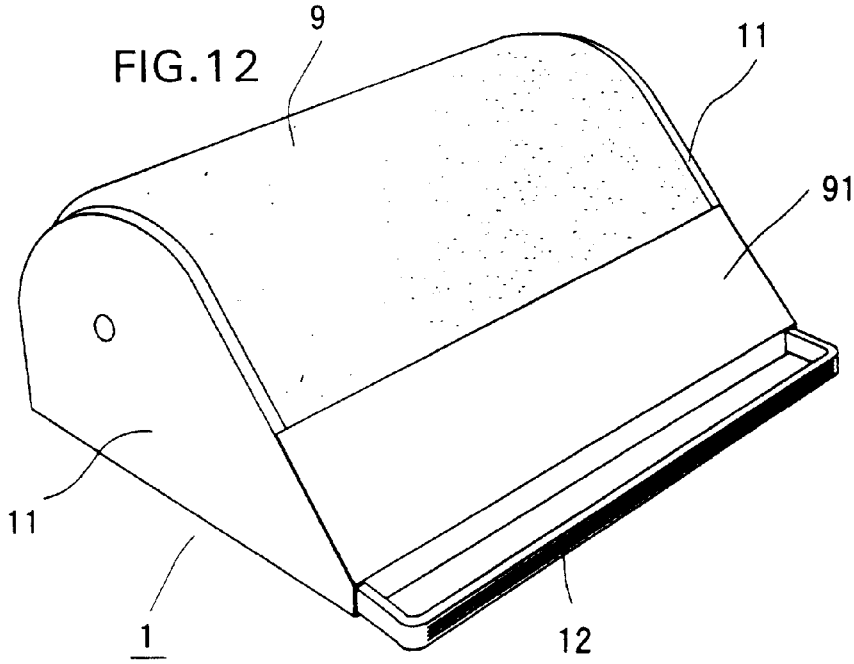
FIG. 12 is an oblique drawing showing a portable massage device which represents another embodiment of this invention.

Said outside frame 1, as shown in FIG. 1, FIG. 11 and FIG. 12, comprises a pair of fixed plates 11·11 and members 12·12 fixed on the two fixed plates 11·11, the members 12 can be used for a handle.

Said driving mechanism 2, as shown in FIG. 1, comprises a driving motor 211 disposed on one of the pair of fixed plates 11·11 of said outside frame 1, a reducer 212 which can change the output rotary speed of said driving motor 211, a gear wheel 22 of a driving shaft 213 disposed on the end of said reducer 212, a driving shaft 25 engaged with said gear wheel 22 of driving shaft 213 for transfering a rotary force to a gear wheel 31 of driven shaft 3, so that the rotary output of driving motor 211 can be transferred to said driven rotary shaft 3 by driving shaft 25, and also the rotary speed can be changed.

Driving gear wheel 23, which is engaged with said gear wheel 22 of driving shaft 213 and said gear wheel 31 of driven shaft 3, is connected with said driving shaft 25, and the rotary output of said driving motor 211 can be transferred to the gear wheel 22 of driving shaft 213 by said reducer 212, so that the driving gear wheel 23 of the driving shaft 25 can transfer the rotary force of the driving motor 211 to said gear wheel 31 of driven shaft 3, and the driven rotary shaft 3 engaged with the said gear wheel 31 can be rotated.

Said driven shaft 3 is rod-shaped and is held between the pair of fixed plates 11·11 by gear wheel 31·31 of the driven shaft on two sides of it, and can be rotated by the rotary of the driving mechanism 2.

A pair of drum shaped tube members 5 receive said shaft 3 therethrough and extend around said driven rotary shaft 3, and a plurality of kneading members 51 are erected at a regular interval from a holding rod 52 in an eccentric position with respect to the axis of driven shaft 3 above said drum shaped tube members 5.

Said drum shaped tube members 5, as shown in FIG. 1 to FIG. 7, are inlaid on two sides of said driven rotary shaft 3 so as to provide massage on two sides. The plurality of kneading members 51 are erected at a regular interval in an eccentric position with respect to the axis above each drum shaped tube member 5·5 so as to contact the part of the human body and provide rolling massage, tapping massage or finger pressure massage with rotation of said driven rotary shaft 3.

As said above, two pairs of said drum shaped tube members 5·5 are respectively inlaid on two sides of said driven rotary shaft 3, and one drum shaped tube member of each pair of members is inclined, and the other is positioned generally vertically. The inclined drum shaped tube members 5 are opposite each other, and a space is formed therebetween.

Figure 4:
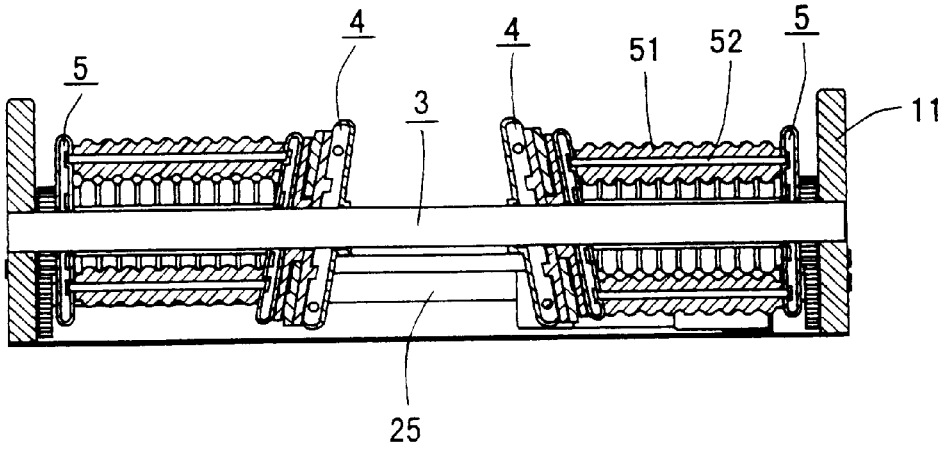
FIG. 4 is a central vertical sectional view showing the status in which a plurality of kneading members of the respective tube members are disposed so that the eccentric positions thereof are 180 degrees out of phase with respect to one another.
Figure 5:
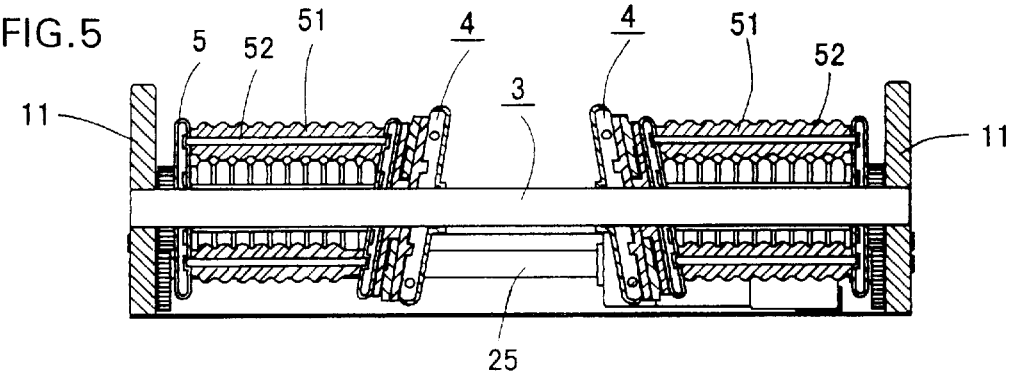
FIG. 5 is a central vertical sectional view showing the status in which a plurality of kneading members of the respective tube members are disposed so that the eccentric positions thereof are the same.
Figure 6:
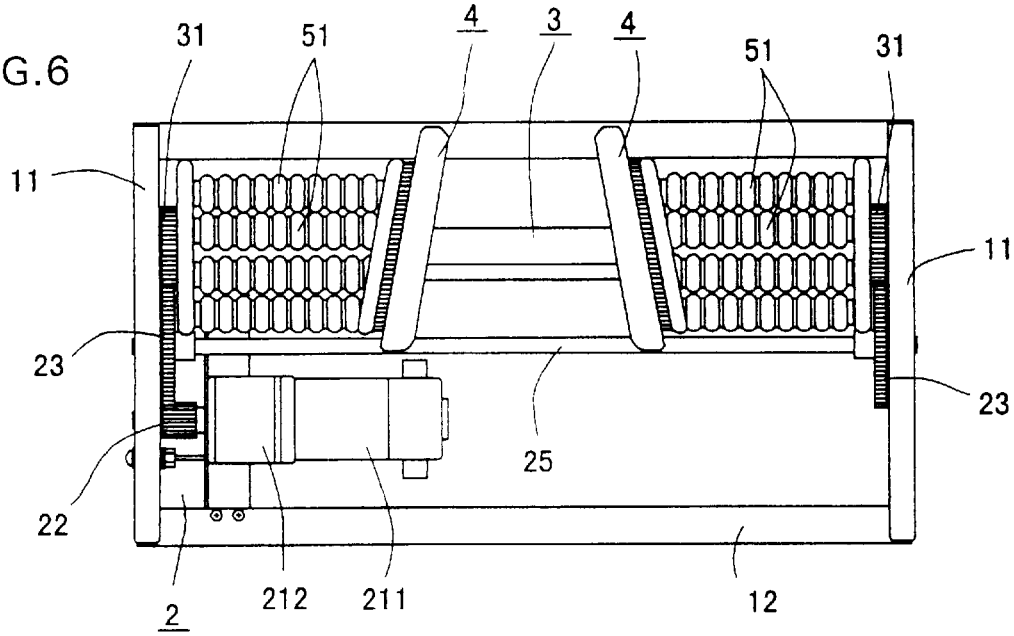
FIG. 6 is a front view of the FIG. 5 arrangement of the kneading members.
Figure 7:
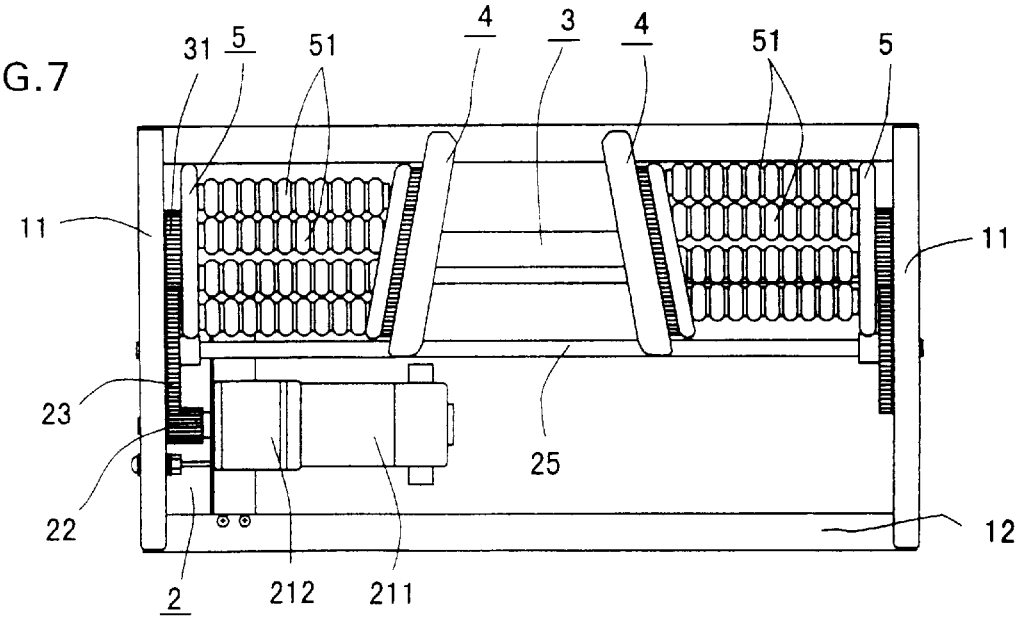
FIG. 7 is a front view of the FIG. 4 arrangement of the kneading members.

Said drum shaped tube members 5·5 are inlaid on two sides of driven rotary shaft 3, and can execute many kinds of motion by directionally changing the eccentric position of each kneading member 51. For example, when the eccentric position is different as shown in FIG. 4 and FIG. 7, and to be 180 degrees, each kneading member 51 will provide finger pressure rolling massage and tapping rolling massage at two sides. Alternatively, as shown in FIG. 5 and FIG. 6, when the eccentric position is the same, each kneading member 51 will provide finger pressure massage and tapping rolling massage at the two sides in the same time.

Figure 8:
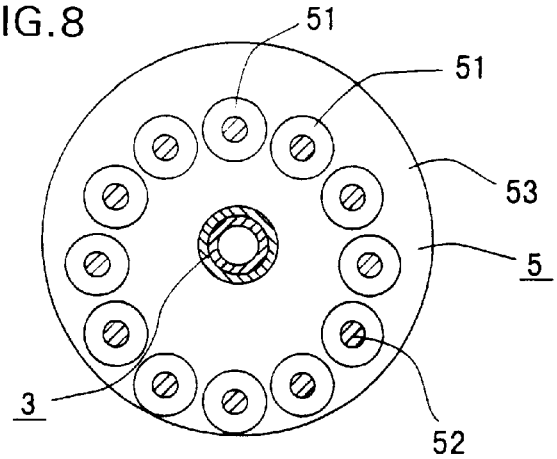
FIG. 8 is a view showing a drum shaped tube member formed with two side edges which are round.
Figure 9:
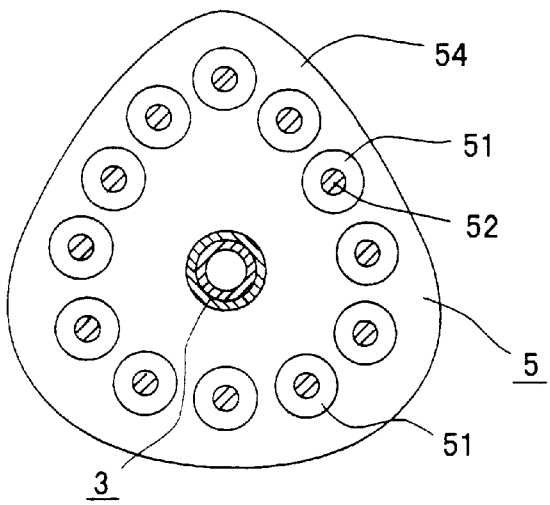
FIG. 9 is a view showing a drum shaped tube member formed with two side edges which are egg shaped.
Figure 10:
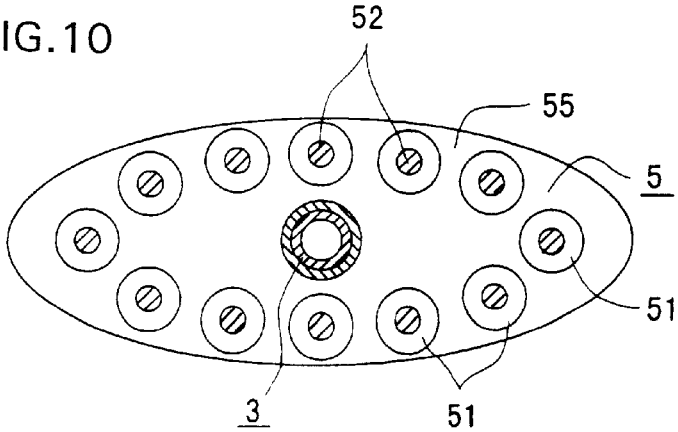
FIG. 10 is a view showing a drum shaped tube member formed with two side edges which are elliptic shaped.

Said drum shaped tube members 5·5, as shown in many drawings, for example, in FIGS. 8–10 are formed to have two round edges 53·53, two egg shaped edges 54·54, and also can be formed with two elliptic shaped edges 55·55. When the two edges 54·54 of drum shaped tube members 5·5 are formed to be egg shaped, a plurality of kneading members 51 may be erected between the egg shaped edges 54·54 at a regular interval. When the two edges 55·55 of drum shaped tube members 5·5 are elliptical, a plurality of kneading members 51 may be erected between each of the edges 55·55.

Further, a pair of round plates 4·4, as shown in FIG. 1 to FIG. 7, are inlaid in eccentric status in the opposite faces of eccentric sides of two drum shaped tube members 5·5 in the center part of said driven rotary shaft 3. When the driven rotary shaft 3 rotates, the two round plates 4·4 will be rotated to grasp the part of the human body to provide a kneading massage.

The two fixed plates 11·11 of said outside frame 1 are erected to Λ-shaped (inverted "V" shaped or egg-shaped) when viewed from side to prevent said kneading members 51 from connecting or interfering with the setting surface when said driven rotary shaft 3 is rotated by said driving mechanism 2 to drive said drum shaped tube members 5.

A cover 9 made of a soft material covers the outsides of said drum shaped tube members 5 and driving mechanism 2 between two fixed plates 11·11 of said outside frame 1 as shown in FIG. 11 and FIG. 12. This cover 9 can soften the force imparted on the user, and can make the portable massage device more beautiful.

91 is a holding foot part for holding a foot, and it can provide heating effect by installing a heater in it.

A technical ability of changing speed or a remote control for controlling the speed is wilfully disposed into the portable massage device of the present invention although same is not shown in any drawings.

As said above, the portable massage device of the present invention comprises a reducer which is installed in the driving mechanism and can change the output speed of the driving mechanism. When the driving mechanism rotates at a high speed, the kneading members can rotate to provide tapping rolling massage and finger pressure rolling massage, and the round plates can provide kneading massage at the same time. When the driving mechanism rotates at a slow speed, the kneading members can rotate to provide finger pressure rolling and tapping rolling massage, and the round plates can provide kneading massage at the same time. The portable massage device of the present invention thus has a simple construction and is inexpensive to manufacture.

Further, the portable massage device of the present invention comprises drum shaped tube members disposed on two sides of the driven rotary shaft, and a plurality of kneading members are erected above each drum shaped tube member in eccentric status with the axis, so that the tapping rolling massage or finger rolling massage can be provided at two sides independently.

Further, the portable massage device of the present invention comprises drum shaped tube members, and in these drum shaped tube members, a plurality of kneading members are erected above in eccentric status with the axis. When the drum shaped tube members are inlaid at two sides of the driven rotary shaft in different eccentric positions, the kneading members erected above on two sides of each drum shaped tube member can provide tapping rolling massage or finger pressure massage in a time difference, and other kneading massage can be provided in the center part. When the drum shaped tube members are inlaid in 180 degrees of eccentric position (out-of-phase), said massages can be provided in two sides alternately.

Further, the portable massage device of the present invention comprises a mechanism part which is opened between a pair of fixed plates of outside frame so as to give about 180 degrees of usable range for providing kneading rolling massage or finger pressure massage, and kneading massage.

Although a particular preferred embodiment of the invention has been disclosed in detail for illustrative purposes, it will be recognized that variations or modifications of the disclosed apparatus, including the rearrangement of parts, lie within the scope of the present invention.

What is claimed is:

1. A portable massage device comprising:

a frame including a pair of fixed frame members;

a drive mechanism fixed to said frame and including a rotatable drive shaft;

a driven rotary shaft rotatable mounted to and extending between said frame members, said driven rotary shaft defining an axis and being driven by said drive mechanism for simultaneous rotation with said rotatable drive shaft;

first and second plates fixed to said driven rotary shaft, said first and second plates being rotatable with said driven rotary shaft;

third and fourth plates fixed to said driven rotary shaft, said third plate being positioned between said first and fourth plates, said fourth plate being positioned between said third and second plates;

a first plurality of massaging members rotatable secured to said first and third plates so as to define a first massage member;

a second plurality of massaging members rotatable secured to said second and fourth plates so as to define a second massage member;

said first and second massage members being arranged eccentrically with respect to the axis of said driven rotary shaft; and said first, second, third and fourth plates being round and concentric to the axis of said driven rotary shaft.

2. The portable massage device according to claim 1, wherein said drive mechanism includes a reducer for changing the output speed of said driving mechanism.

3. The portable massage device according to claim 1 including first and second central plates which face each other and are secured on a central part of said driven rotary shaft, said first and second central plates being eccentric to said axis of said rotary driven shaft and supporting one end of said kneading massaging members of a respective said drum-shaped tube massage member.

4. The portable massage device according to claim 3, wherein said first and second central plates are spaced from each other on said driven rotary shaft so that an empty space is defined between said first and second central plates.

5. The portable massage device according to claim 1, wherein said third and fourth plates extend obliquely to the axis of said driven rotary shaft, and said third and fourth plates are spaced from each other.

6. The portable massage device according to claim 1, wherein said first and second massage members are eccentrically positioned on said driven rotary shaft out-of-phase relative to each other so that a different massage effect is provided to a user by said first and second massage members on different ends of said driven rotary shaft.

7. The portable massage device according to claim 6, wherein said first and second massage members are 180° out-of-phase with each other when rotated by said driven rotary shaft.

8. The portable massage device according to claim 1 wherein said first and third plates are eccentric to said first massage member, and said second and fourth plates are eccentric to said second massage member.

9. A portable massage device comprising:

a frame including a pair of fixed frame members;

a drive mechanism fixed to said frame and including a rotatable drive shaft;

a driven rotary shaft rotatable mounted to and extending between said frame members, said driven rotary shaft defining an axis and being driven by said drive mechanism for simultaneous rotation with said rotatable drive shaft;

first and second plates fixed to said driven rotary shaft, said first and second plates being rotatable with said driven rotary shaft;

third and fourth plates fixed to said driven rotary shaft, said third plate being positioned between said first and fourth plates, said fourth plate being positioned between said third and second plates;

a first plurality of massaging members rotatable secured to said first and third plates so as to define a first massage member;

a second plurality of massaging members rotatable secured to said second and fourth plates so as to define a second massage member;

said first and second massage members being arranged eccentrically with respect to the axis of said driven rotary shaft; and said second and fourth plates being eccentric to said second massage member.

10. The portable massage device according to claim 9 wherein said first and third plates are eccentric to said first massage member.

11. The portable massage device according to claim 9 wherein said drive mechanism includes a reducer for changing the output speed of said driving mechanism.

12. The portable massage device according to claim 9 including first and second central plates which face each other and are secured on a central part of said driven rotary shaft, said first and second central plates being eccentric to said axis of said rotary driven shaft and supporting one end of said massaging members of a respective said massage member.

13. The portable massage device according to claim 12, wherein said first and second central plates are spaced from each other on said driven rotary shaft so that an empty space is defined between said first and second central plates.

14. The portable massage device according to claim 9 wherein said third and fourth plates extend obliquely to the axis of said driven rotary shaft, and said third and fourth plates are spaced from each other.

15. The portable massage device according to claim 9, wherein said first and second massage members are eccentrically positioned on said driven rotary shaft out-of-phase relative to each other so that a different massage effect is provided to a user by said first and second massage members on different ends of said driven rotary shaft.

16. The portable massage device according to claim 15, wherein said first and second massage members are 180° out-of-phase with each other when rotated by said driven rotary shaft.

* * * * *